US011022019B2

(12) United States Patent
Blueml

(10) Patent No.: US 11,022,019 B2
(45) Date of Patent: Jun. 1, 2021

(54) COMPONENT OF AN EXHAUST SYSTEM AND METHOD OF MANUFACTURING SUCH A COMPONENT

(71) Applicant: Faurecia Emissions Control Technologies, Germany GmbH, Augsburg (DE)

(72) Inventor: Alfred Blueml, Gruenwald (DE)

(73) Assignee: Faurecia Emissions Control Technologies, Germany GmbH

( * ) Notice: Subject to any disclaimer, the term of this patent is extended or adjusted under 35 U.S.C. 154(b) by 300 days.

(21) Appl. No.: 15/964,131

(22) Filed: Apr. 27, 2018

(65) Prior Publication Data

US 2018/0313248 A1 Nov. 1, 2018

(30) Foreign Application Priority Data

Apr. 28, 2017 (DE) ..... 10 2017 109 191.2

(51) Int. Cl.
*F01N 13/18* (2010.01)
*F01N 13/14* (2010.01)

(52) U.S. Cl.
CPC ..... *F01N 13/1816* (2013.01); *F01N 13/141* (2013.01); *F01N 13/1844* (2013.01); *F01N 13/1872* (2013.01); *F01N 2450/22* (2013.01); *F01N 2470/24* (2013.01)

(58) Field of Classification Search
CPC ..... F01N 13/1816; F01N 13/1872; F01N 13/141; F01N 13/1844; F01N 2470/24; F01N 2450/22
See application file for complete search history.

(56) References Cited

U.S. PATENT DOCUMENTS 1,639,133 A * 8/1927 Greene ..... F02M 35/024 55/498
3,112,184 A * 11/1963 Hollenbach ..... B28B 1/002 156/89.22
3,913,703 A * 10/1975 Parker ..... F01N 1/06 181/206
4,098,722 A * 7/1978 Cairns ..... B01D 53/86 29/890

(Continued)

FOREIGN PATENT DOCUMENTS

WO 0204197 A1 1/2002

*Primary Examiner* — Grant Moubry
(74) *Attorney, Agent, or Firm* — Carlson, Gaskey & Olds, P.C.

(57) ABSTRACT

A component of an exhaust system, in particular of an exhaust system of an internal combustion engine, has a double-walled pipe which encloses at least one air gap. The double-walled pipe includes at least two layers positioned radially over each other and attached to each other at a plurality of fixing points distributed over a periphery. At least one of the layers is a structured layer and has a wave structure with a plurality of wave crests and wave troughs distributed along the periphery. For manufacturing the component, at least one sheet metal strip is provided, which is structured in sections to give it a wave form. A brazing material is applied at the intended fixing points. The sheet metal strip is then wound up to form the double-walled pipe. The latter is calibrated, and the layers are connected at the fixing points by induction brazing.

9 Claims, 2 Drawing Sheets

(56) References Cited

U.S. PATENT DOCUMENTS 4,186,172 A * 1/1980 Scholz ..... F01N 3/281 29/890
4,192,402 A * 3/1980 Nakagawa ..... F01N 1/04 181/256
4,300,956 A * 11/1981 Rosenberger ..... B23K 20/00 148/285
4,521,947 A * 6/1985 Nonnenmann ..... B23K 1/0014 29/890
4,713,361 A * 12/1987 Maus ..... B01J 35/04 428/116
4,744,440 A * 5/1988 Hanson ..... F01N 1/003 181/227
4,842,954 A * 6/1989 Cyron ..... B01J 35/04 428/592
5,045,403 A * 9/1991 Maus ..... B01J 35/04 428/593
5,068,218 A * 11/1991 Nishizawa ..... B01J 32/00 428/593
5,177,960 A * 1/1993 Hitachi ..... B01J 35/04 422/180
5,402,928 A * 4/1995 Preston ..... B01J 35/04 228/181
5,464,679 A * 11/1995 Maus ..... B01J 35/04 428/116
5,618,501 A * 4/1997 Wieres ..... B01J 35/04 422/180
5,737,839 A * 4/1998 Whittenberger ..... B01J 35/04 29/890
6,109,386 A * 8/2000 Maus ..... B01J 35/04 181/158
6,364,055 B1 * 4/2002 Purdy ..... F01N 1/06 181/268
6,389,694 B1 * 5/2002 Tokunaga ..... B01J 35/04 29/428
6,586,110 B1 * 7/2003 Obeshaw ..... B21C 37/15 138/148
7,600,607 B2 * 10/2009 Sullivan ..... F01N 5/025 181/250
8,336,176 B2 * 12/2012 Hodgson ..... B01J 35/04 29/6.1
8,485,312 B2 * 7/2013 Sakae ..... F16L 55/0336 181/249
8,607,923 B2 * 12/2013 Takagaki ..... F01N 1/02 181/249
2008/0141665 A1 * 6/2008 Yusa ..... F28F 1/08 60/320
2012/0117956 A1 * 5/2012 Gaiser ..... F01N 3/101 60/320

* cited by examiner

COMPONENT OF AN EXHAUST SYSTEM AND METHOD OF MANUFACTURING SUCH A COMPONENT

CROSS-REFERENCE TO RELATED APPLICATION

This application claims priority to DE 10 2017 109 191.2, filed Apr. 28, 2017.

FIELD OF INVENTION

The invention relates to a component of an exhaust system, in particular of an exhaust system of an internal combustion engine, and to a method of manufacturing such a component.

BACKGROUND

When manufacturing components of an exhaust system which have a plurality of component parts, these parts are frequently prefabricated separately and require time-consuming assembly to yield a finished component.

This also applies to components that have a double-walled pipe with an air gap. For the fabrication of such a double-walled pipe, often a number of different machines are employed, which extends the processing time.

It is the object of the invention to simplify the production of such a component.

BRIEF DESCRIPTION OF THE INVENTION

According to the invention, a component of an exhaust system, in particular of an exhaust system of an internal combustion engine, has a double-walled pipe which encloses at least one air gap. The double-walled pipe includes at least two layers positioned radially over each other and attached to each other at a plurality of fixing points distributed over the periphery. At least one of the layers is a structured layer and has a wave structure with a plurality of wave crests and wave troughs distributed along a periphery. The structured layer is disposed in the air gap or contributes to defining the air gap, and also maintains the distance between the at least two layers. Fixing the wave crests and wave troughs in position is obtained via the fixing points distributed over the periphery. The number of fixing points is preferably greater than 10 in order to achieve a secure fixing in position. Such a component is simple to manufacture by winding, with all processing steps being adapted to be carried out in a single production device.

Preferably, a brazing/soldering material is applied directly onto the individual layers at the later fixing points, so that the layers can be fixed to each other by induction brazing/soldering. As used below, the term "brazing" is intended to also include soldering.

Additionally, support mats and spacers, for example, may also be placed between the individual layers.

Similarly, it is possible to incorporate openings, in particular micro-perforations, into the individual layers, for example by punching or laser cutting. This is also advantageously effected before the layers are rolled up to form a pipe.

The wave structure may be rounded and may feature a steady gradient at any point, such as in a sinusoidal shape, for example.

It is also possible to have an angular wave structure, for example having a zigzag profile, that is, with a non-steady gradient. In this case, the neighboring sections may adjoin each other forming a bend, for example at an angle of 30 to 120 degrees.

The wave crests and wave troughs may define a first wave form having a small frequency, i.e. a large distance between wave crests and wave troughs, which establishes the basic shape of the structured layer. In addition, a structuring may be provided which has a higher frequency, but a smaller amplitude, so that in particular the flanks between the wave crests and the wave troughs have a small-scale structuring, for example in the form of waves or bends.

It is possible to provide a fixing point at each wave crest and/or each wave trough, but the fixing points may also be arranged on the flanks between the wave crests and the wave troughs.

In a preferred embodiment, at least one of the structured layers does not extend in a straight line between two neighboring fixing points, at least in sections. In this way, a higher elasticity is achieved than with a straight-line profile, which increases the load-bearing capacity of the double-walled pipe.

The non-straight profile may be formed here by a continuous curvature, for example a part of a sine curve, but also by a bend in which two straight-line sections adjoin each other.

Preferably, the structuring is configured such that the structured layer does not extend in a straight line between each wave crest and each wave trough. This results in the structured layer retaining sufficient inherent elasticity even if a fixing point is formed at each wave crest and each wave trough.

In a first possible embodiment, the wave structure has essentially a sinusoidal shape and at least one of the fixing points is positioned outside the wave crests or troughs of the sinusoidal shape. For example, the fixing point may be in the region of the zero crossing. In this way, a number of air chambers, which form an air insulation, are obtained between the layers for shape-related reasons. At the same time, sufficient elasticity is maintained between the fixing points owing to the curvature of the structured layer. The air gap may be formed by these air chambers, or the latter may be provided in addition to one or more further air gaps.

Preferably, the majority of the fixing points are positioned outside the wave crests or wave troughs of the sinusoidal shape.

In particular, two layers are provided, both of which are bent in a sinusoidal shape, preferably with the same frequency and amplitude. The two layers are advantageously shifted in relation to one another, so that when they are connected, a separate air gap is obtained for each period of the sine wave.

For example, the two layers may be shifted relative to one another by a phase of about $\pi/4$, the fixing points being positioned between the zero crossing and the wave trough of one structured layer and/or in the region of the zero crossing of the other structured layer. In these positions, the two structured layers can be fixed to each other in a simple manner, and large air chambers are obtained between the individual fixing points.

It is possible to fabricate the double-walled pipe solely from the two layers bent in a sinusoidal shape, but further flat or structured layers could also be provided.

In a further preferred embodiment, the radially innermost and/or the radially outermost layer is/are formed to be flat, so that the inside cross-section and the outer wall of the double-walled pipe exhibit no structuring.

In this connection, "flat" is understood to mean that no additional structuring is incorporated into the layer.

Arranged between a flat radially innermost layer and a flat radially outermost layer is, for example, a structured layer having a wave structure, the structured layer being attached at its wave troughs and its wave crests to the radially innermost or the radially outermost layer.

The structured layer may be designed to have, e.g., a simple sinusoidal shape or a simple zigzag shape. Preferably, however, in addition to a long-wave wave structure, the structured layer has a respective bend between the wave troughs and the wave crests, which increases its elasticity.

Generally, both layers may each be formed by winding a one-piece sheet metal strip that is structured in sections. In this case, the individual successive sections of the sheet metal strip are dimensioned such that the intended circumference for the respectively desired radial position of each individual layer of the double-walled pipe is obtained upon winding.

For example, the sheet metal strip may have a structuring in a central section which later forms a structured layer arranged radially between two flat layers after the winding-up process.

Alternatively, it is of course also possible to cut the individual layers to size and stack them on top of each other before winding.

There is, of course, always the option of incorporating openings into each of the layers and applying a brazing material between the layers onto the later fixing points already prior to the rolling-up process.

The flat layers may also be formed integrally with the structured layer(s) and may reach their intended positions by the winding process.

The winding is normally performed over more than 360 degrees, for example over 2 times 360 degrees if a total of only two layers are provided, over 3 times 360 degrees if one single inner structured layer is provided between two outer layers, or over 4 times 360 degrees or correspondingly more for two or more inner structured layers.

A preferred method of manufacturing a component described above includes the following steps:

- providing at least one sheet metal strip;
- structuring the sheet metal strip in sections to give it a wave form;
- applying a brazing material at the intended fixing points;
- winding up the sheet metal strip to form a double-walled pipe;
- calibrating the double-walled pipe; and
- brazing the layers at the fixing points by induction brazing.

The sheet metal strip may be supplied from an endless roll. As described above, the individual layers of the double-walled pipe may be realized by sections of the sheet metal strip that continue into one another in one piece and succeed one another in the longitudinal direction, the structured sections then being structured before the rolling-up process. It is just as well possible to cut sheet metal strips from an endless roll to a suitable length, structure them if necessary, and stack them on top of each other before winding.

According to the invention, a very thin metal sheet having a wall thickness of only about 0.1 mm to 0.3 mm, in particular about 0.2 mm, may be used, since sufficient stability is achieved based on the processing in a plurality of layers.

If it is intended to use a plurality of structured layers, they may be applied one behind the other in suitable places along the sheet metal strip, if desired.

Prior to the winding, further elements such as, for example, support mats, spacers or end seals may, of course, also be applied to the sheet metal strip(s) and rolled up together therewith.

Likewise, it is possible to provide the sheet metal strip(s) with openings, for example perforations, at suitable and desired places before the rolling-up process.

Calibration of the wound-up pipe is effected, for example, by a device having punches that are linearly displaceable in the radial direction, the device reducing the outside diameter of the double-walled pipe to a desired dimension.

Fixing the layers to one another at the fixing points is preferably performed in the calibration position by inductive heating of the brazing material applied onto the sheet metal strip(s), so that the shape obtained by calibrating can be simply maintained.

All of the method steps may be carried out in one single device, the finished component being removed from the device after brazing. It is not required to change the device.

BRIEF DESCRIPTION OF THE DRAWINGS

The invention will be described in more detail below by several exemplary embodiments with reference to the accompanying drawings, in which.

DETAILED DESCRIPTION

Figure 1:
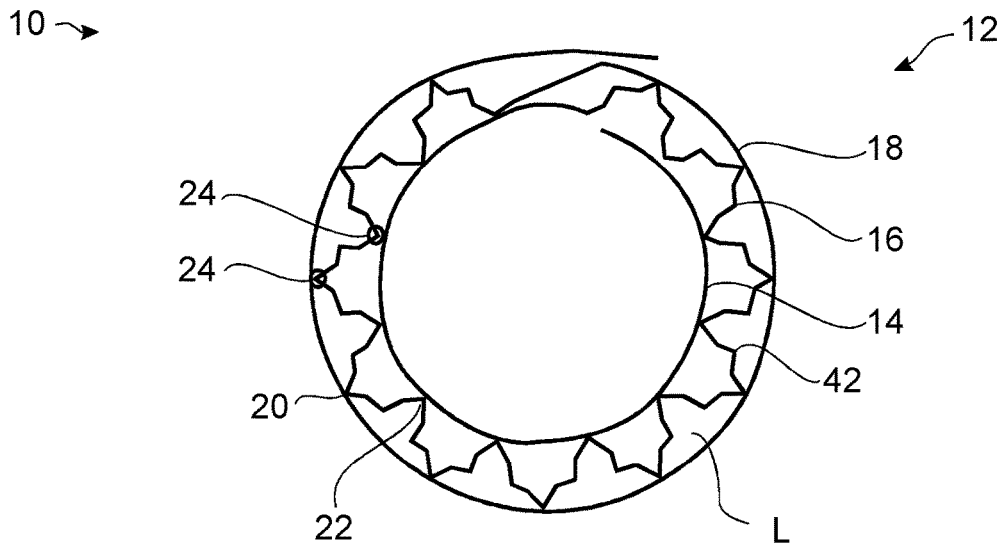
FIG. 1 shows a schematic sectional view of a component of an exhaust system according to a first embodiment of the invention.
Figure 2:
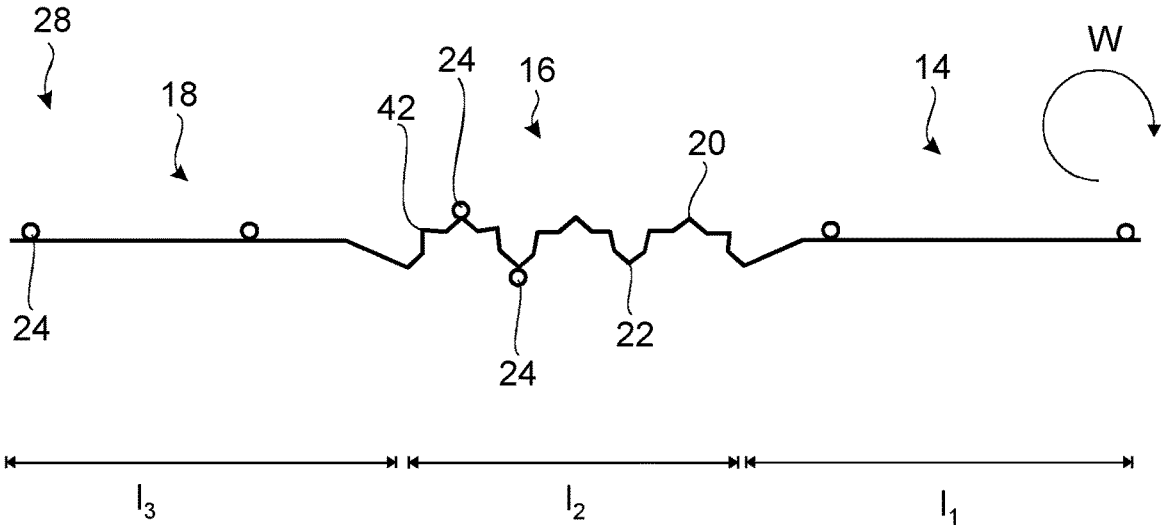
FIG. 2 shows a sheet metal strip which is structured in sections and from which the layers of the component shown in FIG. 1 are wound.

FIGS. 1 and 2 show a component 10 of an exhaust system according to a first embodiment. For reasons of clarity, where features occur several times, only some of them are provided with reference numerals in the figures.

The component 10 comprises a double-walled pipe 12, which may extend over any desired length and encloses a cavity in its interior. The component 10 may be made use of as an exhaust pipe, for example, but also in a muffler or as a housing for other suitable parts of an exhaust system which may be received in the interior of the double-walled pipe 12, if appropriate.

In this example, the double-walled pipe 12 includes three layers 14, 16, 18, of which the layer 14 constitutes the radially innermost layer and the layer 18 constitutes the radially outermost layer. The layer 16 is positioned between the layers 14 and 18 as viewed in the radial direction.

The layer 16 is a structured layer which has a wave structure with quite a number of wave crests 20 and wave troughs 22 distributed over the periphery of the double-walled pipe 12. The wave crests 20 are arbitrarily chosen as being directed radially outward here, while the wave troughs 22 accordingly constitute the radially most inward points of the wave structure.

The period of the wave structure is selected such that more than ten wave crests are provided and distributed over the periphery. Depending on the selected wave structure and the selected diameter of the double-walled pipe 12, this number may also be smaller, but may also be considerably higher.

At least some of the wave crests 20 and/or the wave troughs 22 have fixing points 24 provided thereon, at which the layers 14, 16 and also the layers 16, 18 are attached to each other. It is possible to provide a fixing point 24 at each of the wave crests 20 and each of the wave troughs 22, or only at some of the wave crests 20 and wave troughs 22.

The attachment to the fixing points 24 is effected using brazing material at these locations as indicated in the figures.

In this example, all of the layers 14, 16, 18 are made of a metal sheet. The wall thickness of the sheet is between 0.1 and 0.3 mm, and in particular about 0.2 mm.

To produce the double-walled pipe 12, the sheet metal strips, which later form the layers 14, 16, 18, are rolled up.

In this embodiment, all three layers 14, 16, 18 are integrally connected with each other and form part of a single elongated sheet metal strip 28, with the layers 14, 16, 18 following each other linearly. It is only by rolling in the winding direction W (see FIG. 2) that the layer structure of the double-walled pipe 12 is obtained. The lengths 11, 12, 13 of the later layers 14, 16, 18 are exactly selected such that they correspond to the respective periphery of the layers 14, 16, 18 in the finished double-walled pipe 12, and if necessary including an overlap of a few millimeters in order to attach the layers 14, 16, 18 to the respective neighboring layer.

Figure 4:
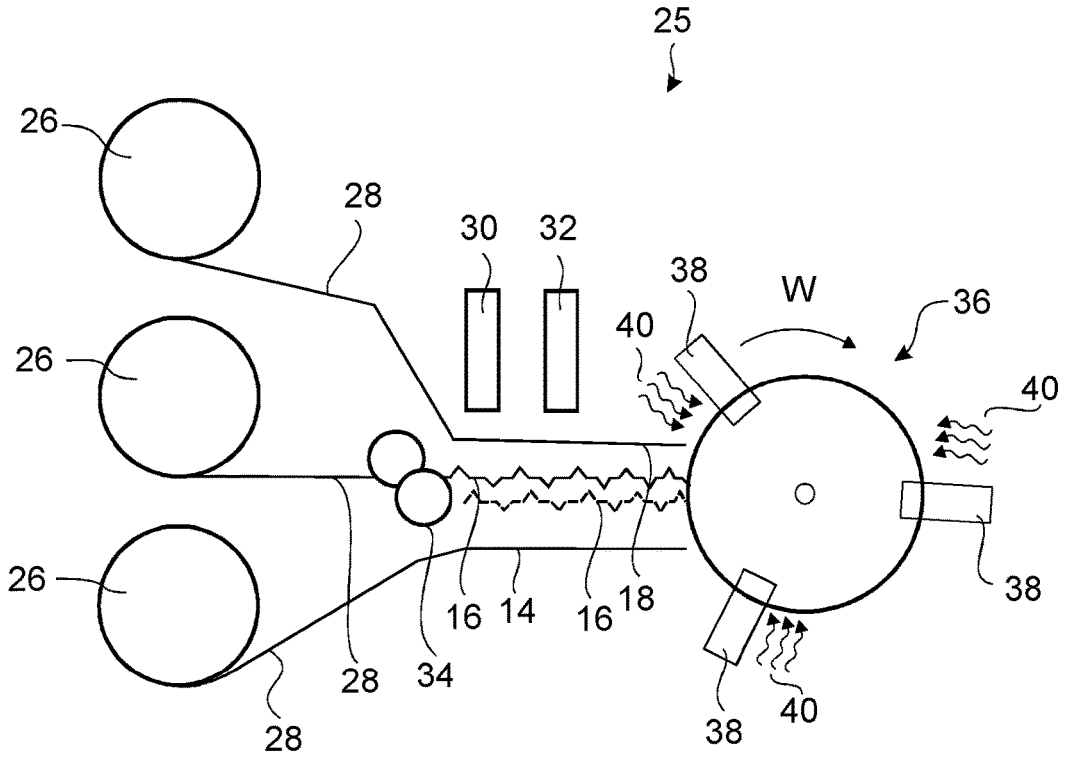
FIG. 4 shows a schematic illustration of a device for producing a component according to the invention.

For manufacturing the double-walled pipe 12, a device is provided which is not illustrated in more detail, but which is designed similar to the production device 25 shown in FIG. 4, to which reference is therefore made here.

One of the sheet metal strips 28 having the desired wall thickness is fed from a supply roll 26.

The sheet metal strip 28 is provided with a brazing material at predetermined points, these points forming the fixing points 24 later.

The brazing material may also be fed in strips from corresponding supply rolls 30. The fixing points 24 may each extend over the entire length of the double-walled pipe 12 (i.e. into the drawing plane) or be formed with interruptions.

Openings may also be applied into the sheet metal strips 28 at predefined points, for example by punching or laser cutting, such as (micro)-perforations for noise reduction (indicated by device 32).

The structured layer 16 is brought into the desired wave form in the production device 25, e.g. by a suitable embossing tool 34.

In addition, spacers and/or seals (not shown) may already be arranged on the sheet metal strip 28.

Following these preparatory steps, the sheet metal strip 28 is rolled up in the winding direction W, starting with the radially innermost layer 14.

The roll produced in this way is calibrated to its final shape and size in a calibrating device 36, for example by punches 38 traveling radially inwards and acting on the outer layer 18. This calibrating device 36 can be integrated into the production device 25, so that the rolled-up sheet metal strip 28 does not need to be transferred to another device. The fixing in the final shape is effected by inductive heating of the brazing material, so that the respective neighboring layers are brazed to each other at the fixing points 24. The induction device 40 is integrated in the calibrating device 36, for example, the induction brazing being performed as long as the punches 38 are still in the final position of calibration.

After completion, the component 10 is removed from the production device 25. The production device 25 is then available for the production of a further component 10.

All production steps can be carried out in succession in one single production device 25.

It is, of course, possible to carry out the step of structuring with a wave form prior to the application of brazing material or the incorporation of openings, or later.

A plurality of structured layers 16 may also be provided. It is possible to form all existing layers as structured layers or to design one or more of the layers as flat layers, i.e. without selectively reshaping such layer(s) to achieve a structuring.

The number of layers corresponds to the number of revolutions of the sheet metal strip 28 in the winding direction W, a revolution of 360 degrees in the winding direction W being required to generate a complete layer.

The wave form selected in this embodiment is essentially composed of sections extending in a straight line, which adjoin each other in bends forming the wave crests 20 and the wave troughs 22. In the wave crests 20 and the wave troughs 22, the adjacent sections may form angles between 30 degrees and 120 degrees, for example.

It would be conceivable to form the wave structure from a simple zigzag structure in which respective bends are only provided in the wave crests 20 and in the wave troughs 22.

In the example shown here, however, the flank between each wave crest 20 and each wave trough 22 has a further bend 42 provided thereon, where the material of the structured layer 16 projects outward, that is, toward the radially outermost layer 18. These bends 42 are positioned freely in the air gap L formed between the radially innermost layer 14 and the radially outermost layer 18.

Owing to the additional bends 42, the structured layer 16 does not extend linearly between the wave crests 20 and the wave troughs 22. This results in an increased elasticity, which improves the overall stability of the double-walled pipe 12.

Figure 3:
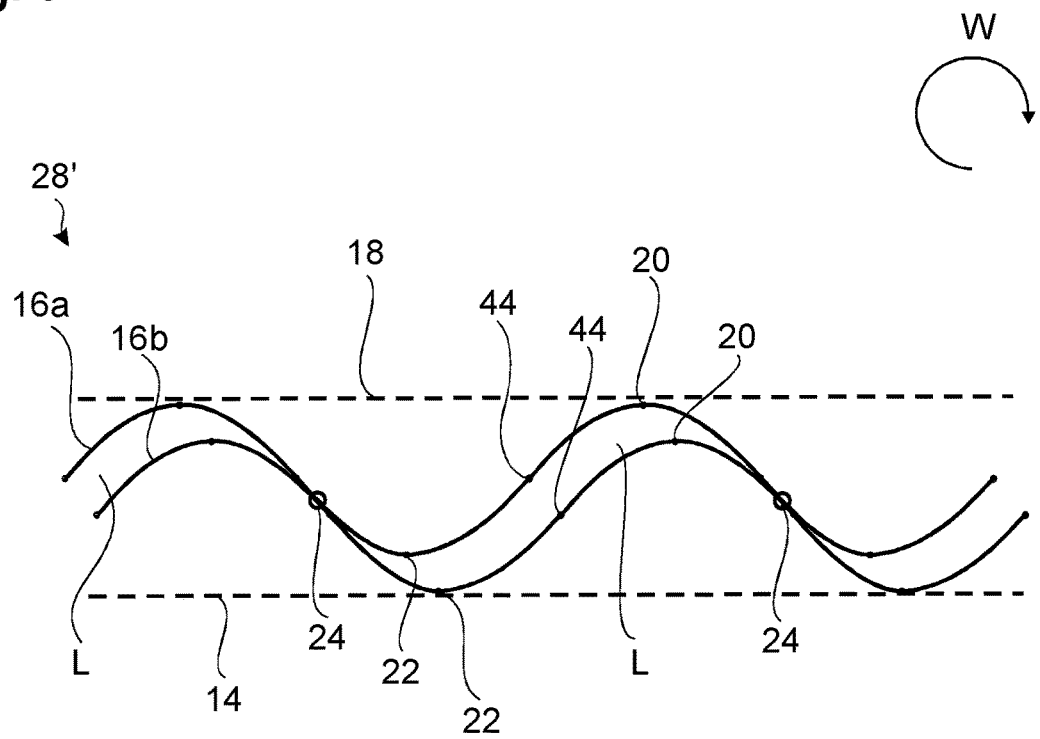
FIG. 3 shows a schematic sectional view of a stack of layers for a component of an exhaust system according to a second embodiment, prior to the rolling-up process.

FIG. 3 illustrates a component according to a second embodiment of the invention.

Here, the double-walled pipe 12 is produced by winding up a stack of two structured layers 16*a*, 16*b*, which are placed on top of each other as is illustrated in FIG. 4.

Each of the structured layers 16*a*, 16*b* here has a sinusoidal shape with the same period and the same amplitude. Of course, a different wave form could also be selected, which does not correspond to a mathematically exact sine, but also extends periodically and without any sharp bends, that is, discontinuities in the gradient.

The two structured layers 16*a*, 16*b* are shifted relative to each other such that they touch each other away from the wave crests 20 and the wave troughs 22, in this case by a phase of about $\pi/4$. At these locations, the fixing points 24 are provided. The fixing points 24 are thus located in the region of a zero crossing 44 of the structured layer 16*b* or between the zero crossing 44 and the wave trough 22 of the structured layer 16*a*, for example.

In this case, a plurality of respective air gaps L are formed between the neighboring fixing points 24.

In a variant of the embodiment just described, two further layers 14, 18 which are flat, that is, unstructured, are provided on either side of the two structured layers 16*a*, 16*b*, forming the radially innermost layer 14 and the radially outermost layer 18 in the finished double-walled pipe 12 as in the first embodiment. In this case, a further air gap L is then formed between the layer 14 and the layer 18.

With the difference that the sheet metal strips 28' are stacked on top of each other and positioned accordingly before the rolling-up process, the production can take place in the production device 25 shown in FIG. 4, as described for the first embodiment.

In this case, a plurality of supply rolls 26 are provided, for example, from which the individual sheet metal strips 28, 28' are fed to a stacking area in which the individual layers 14, 16*a*, 16*b*, 18 are stacked on top of each other in the desired order after structuring in the embossing tool 34, if desired. Of course, some or all layers 14, 16*a*, 16*b*, 18 may also be fabricated from blanks from a single supply roll 26, if required.

Rather than placing all of the layers 14, 16*a*, 16*b*, 18 on top of each other to form a stack before rolling them up, it would also be conceivable, by analogy with the first embodiment, to provide a single, elongated sheet metal strip which includes the individual layers 14, 16*a*, 16*b*, 18 linearly adjoining each other with the appropriate lengths, the layers assuming their desired positions after being rolled up in the winding direction W. In this case, too, the brazing material for the fixing points 24 may be applied prior to stacking the individual layers on top of each other and prior to rolling them up, and fixing of the individual layers 14, 16*a*, 16*b*, 18 to one another may be obtained by inductive heating after the rolling-up process.

Stacking the individual layers 14, 16, 18 before rolling them up would also be possible in the first embodiment.

In addition, rather than the basic wave form shown in the first embodiment, a sinusoidal shape or a sine-like shape as used in the second embodiment may, of course, also be used there.

Generally, it is conceivable to provide only one single structured layer 16, 16*a*, 16*b* or any desired number of radially superposed structured layers 16, 16*a*, 16*b*. Likewise, the radially innermost layer and/or the radially outermost layer may generally have a flat design.

The wave forms shown have been chosen by way of example only. Of course, any suitable wave form that preferably does not extend linearly between wave crests and wave troughs can be employed in a component according to the invention for an exhaust system.

The invention claimed is:

1. A component of an exhaust system comprising:

a double-walled pipe which encloses at least one air gap, the double-walled pipe enclosing a cavity in an interior of the double-walled pipe, and the double-walled pipe being an exhaust pipe, a muffler or a housing for a part received within the cavity of the double-walled pipe, and wherein the double-walled pipe includes at least two layers positioned radially over each other and attached to each other at a plurality of fixing points distributed over a periphery, at least one of the layers being a structured layer and having a wave structure with a plurality of wave crests and wave troughs distributed along the periphery;

wherein the wave structure has essentially a sinusoidal shape and at least one of the fixing points is positioned outside the wave crests or wave troughs of the sinusoidal shape wherein two structured layers are provided, both of which are bent in a sinusoidal shape with the same frequency and amplitude; and wherein the two structured layers are shifted relative to one another by a phase of about $\pi/4$ and the fixing points are positioned between a zero crossing and the wave trough of one structured layer and/or in a region of a zero crossing of the other structured layer.

2. The component of claim 1 wherein at least one of the structured layers does not extend in a straight line between two neighboring fixing points, at least in sections.

3. The component of claim 1 wherein the structured layer does not extend in a straight line between each wave crest and each wave trough.

4. The component of claim 3 wherein, formed between the wave crest and the wave trough, is a bend in which two straight-line sections adjoin each other.

5. The component of claim 1 wherein at least a majority of the fixing points are positioned outside the wave crests or wave troughs of the sinusoidal shape.

6. The component of claim 1 wherein a radially innermost and/or a radially outermost layer is/are formed to be flat.

7. The component of claim 6 wherein the flat radially innermost layer and the flat radially outermost layer are provided, between which the structured layer having the wave structure is arranged, the structured layer being attached at the wave crests and the wave troughs to the flat radially outermost layer and the flat radially innermost layer and, more particularly, the structured layer having a respective bend between neighboring wave crests and wave troughs.

8. The component of claim 1 wherein at least two of the layers are formed by winding.

9. The component of claim 8 wherein at least two of the layers are formed by winding a one-piece sheet metal strip that is structured in sections.

* * * * *